US006247888B1

(12) United States Patent
Guiet

(10) Patent No.: US 6,247,888 B1
(45) Date of Patent: Jun. 19, 2001

(54) PARKING STAND FOR TRACTOR FRONT END LOADER

(75) Inventor: Lionel Guiet, Valay (FR)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/362,489

(22) Filed: Jul. 28, 1999

(30) Foreign Application Priority Data

Aug. 1, 1998 (DE) ..... 198 34 773

(51) Int. Cl.[7] ..... E02F 3/627
(52) U.S. Cl. ..... 414/686; 172/274
(58) Field of Search ..... 414/685, 686; 172/274

(56) References Cited

U.S. PATENT DOCUMENTS

| | | | | |
|---|---|---|---|---|
| 4,257,730 | * | 3/1981 | Kawakita | 414/686 |
| 4,264,264 | * | 4/1981 | McMillan et al. | 414/686 |
| 4,347,031 | * | 8/1982 | Friesen et al. | 414/686 |
| 4,522,554 | * | 6/1985 | Williams et al. | 414/686 |

FOREIGN PATENT DOCUMENTS 1990849 2/1967 (DE) .

OTHER PUBLICATIONS

Advertising Brochure of Ab Alö–Maskiner, Sweden, dated 1993.

Advertising Brochure of Trima Ltd., 33 Tatton Court, Kingsland Grange, Warrington WA 1 4RR, pp. 1 (cover), 5 and 16 (back) dated 1991.

Advertising Brochure of Farmhand, 525 15$^{th}$ Avenue South, Hopkins, MN (not dated but prior art to the instant application), cover and rear page plus two interior pages.

* cited by examiner

*Primary Examiner*—Donald W. Underwood

(57) ABSTRACT

A loader 10 includes a loader boom having opposite sides defined by arms to each of which is pivotally mounted a portion of a parking stand assembly including a support leg and a strut with the pivot axis for the leg being spaced between the implement at the end of the boom and the pivot axis for the strut. The support leg includes a pair of sides connected together by a web so as to be generally H-shaped in cross section over a major portion of its length. The web contains an opening through which the strut extends with the strut being in the channel defined below the support leg web and both the support leg and strut extending along the underside of the loader arm when the parking stand is in its stored position. The channel defined above the web receives the lower portion of the loader arm. A releasable fastener couples the strut to the arm, the strut in turn holding the support leg in place. When the fastener is released, the strut and arm gravitate toward a park position which is effected when a receptacle adjacent the end of the strut comes into engagement with a cross pin mounted to the support leg at a location close to the opening. The strut carries a hook which faces the receptacle and functions to prevent the strut from becoming withdrawn from the opening in the support leg web and thus separating from the leg.

8 Claims, 3 Drawing Sheets

PARKING STAND FOR TRACTOR FRONT END LOADER

This invention concerns a loader having a loader boom to which a parking stand is attached, the stand including a support leg and strut respectively pivotally mounted to the boom for pivoting freely about first and second pivot axes between stored and park positions of the parking stand, with retaining means being present to releasably secure the stand in the stored position and the strut then being operative when the stand is moved to its park position to anchor the support leg.

BACKGROUND OF THE INVENTION

Loaders are mounted to agricultural or industrial vehicles such as, for example, agricultural tractors. They are frequently provided on the front side of the vehicle, but may also be attached to its rear side. When the loader is not needed, it can be removed from the vehicle and parked. For this purpose, known loaders, for example, a loader of Series Q of Ålö (Prospectus No. 11 24 575), are provided with parking stands that are pivotally mounted to the loader boom for movement between raised stored positions and lowered park positions. When parked, the loader is in a lowered condition so as to be supported in part by a bucket coupled to one end of the loader boom and further by respective support legs of the parking stands. When the loader is installed on the tractor, the support legs are swiveled upward into their stored positions in which they are in contact with the loader boom and are secured in the usual manner by retaining pins, or the like, in order to avoid interfering with the operation of the loader. In order to park the loader, the retaining pins must be removed so as to permit the support legs to swivel down to their parking positions. Beyond that, each parking stand includes a strut that is also pivotally attached to the loader boom. The strut is provided with a support component which may be engaged with the edge of an opening located in the support leg after the support leg has been pivoted to its park position. In order to assure a durable positive lock between the edge of the support leg opening and the support component of the strut, the support component is secured in the opening in the usual manner, for example, by means of the aforementioned retaining pin. After the loader is installed on the tractor, the retaining means must be released, the strut and the support leg disconnected from each other, and both the strut and the supporting leg must be pivoted manually in the upward direction. The strut and unloading support must be separately guided manually so that the strut comes to lie between the support leg and the loader boom. While the known parking stand arrangements function properly, the structure for permitting the movement of the support leg and strut between stored and park positions is not quite as simple as desired which results in the arrangement being more costly than is necessary.

SUMMARY OF THE INVENTION

According to the present invention there is provided an improved parking stand arrangement for a tractor front end loader.

An object of the invention is to provide a front end loader parking stand arrangement which is of a simple, compact construction which may be easily moved between stored and parking positions.

A more specific object of the invention is to provide a front end loader parking stand arrangement including a pair of support legs, which are each pivotally mounted to a respective arm of the loader boom, and including a pair of supporting strut which respectively hold the support legs in a stored position against the underside of associated loader arm when the strut is in its stored position and releasably secured to the loader boom, the strut having a support component in the form of a receptacle which is brought into engagement with a cross pin carried by the support leg when the support leg and strut are lowered to establish the parking stand park position.

These and other objects will become apparent from a reading of the ensuing description together with the appended drawings.

DESCRIPTION OF THE PREFERRED EMBODIMENT

Figure 1:
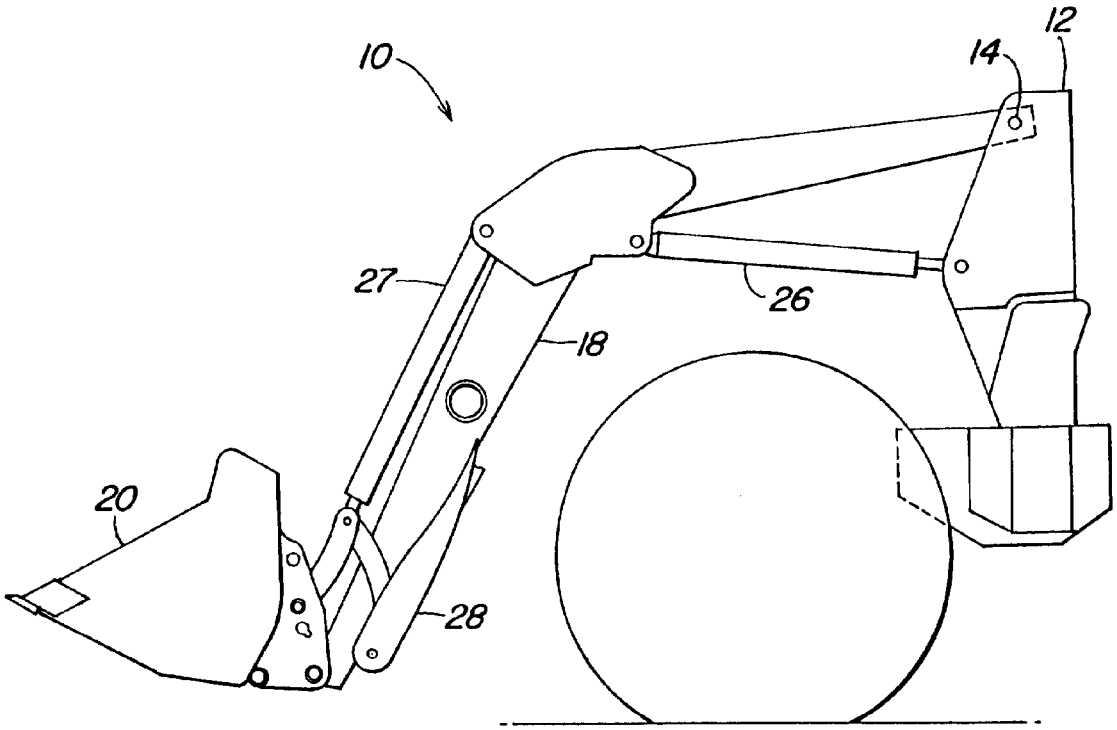
FIG. 1 is a left side elevational view of a front end loader together with a schematic representation of a forward part of an agricultural tractor to which the loader is attached.

Preliminarily, it is to be noted that while some structure is described as occurring in pairs only one of the pair is depicted in the drawings with it to be understood that the one of the pair not illustrated is the same as, or the mirror image of, the one shown.

A front end loader 10 is shown in FIG. 1 and is attached to the front side of an agricultural tractor which is only schematically indicated. At each side of the tractor there is provided a mast 12 having a pin 14 provided at its upper end and defining a bearing to which a rear end of a respective loader arm 18, defining opposite sides of a loader boom, is mounted for pivoting vertically. An implement, here shown as a bucket 20, is connected to the front ends of the loader arms 18 for pivoting vertically and so as to be selectively disconnected and interchanged with other implements. In order to raise the bucket 20, the loader arms 18 are pivoted about the pins 14 by a pair of hydraulic motors 26 respectively coupled between each mast 12 and the associated loader arm 18. A further pair of hydraulic motors 27 are used to control the disposition of the bucket 20 about its pivotal connections with the forward ends of the arms 18.

Figure 2:
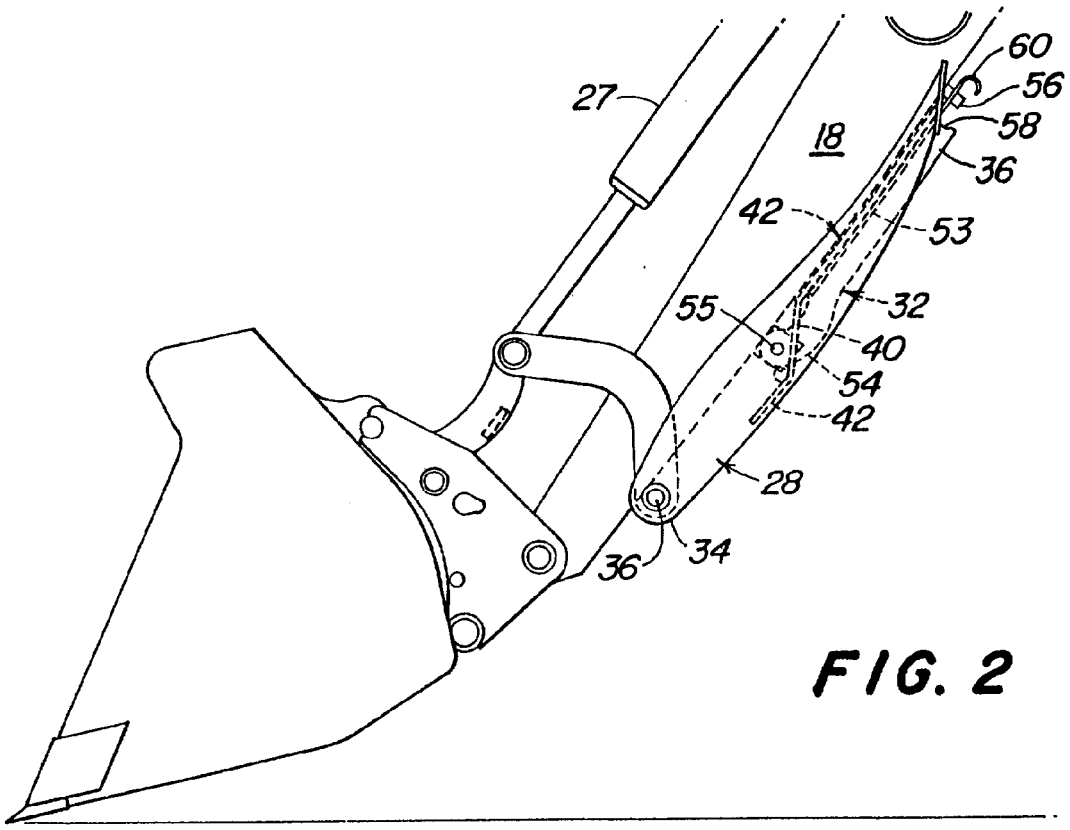
FIG. 2 is an enlarged left side elevational view of a forward region of the front end loader showing its parking stand in a stored or transport position.
Figure 4:
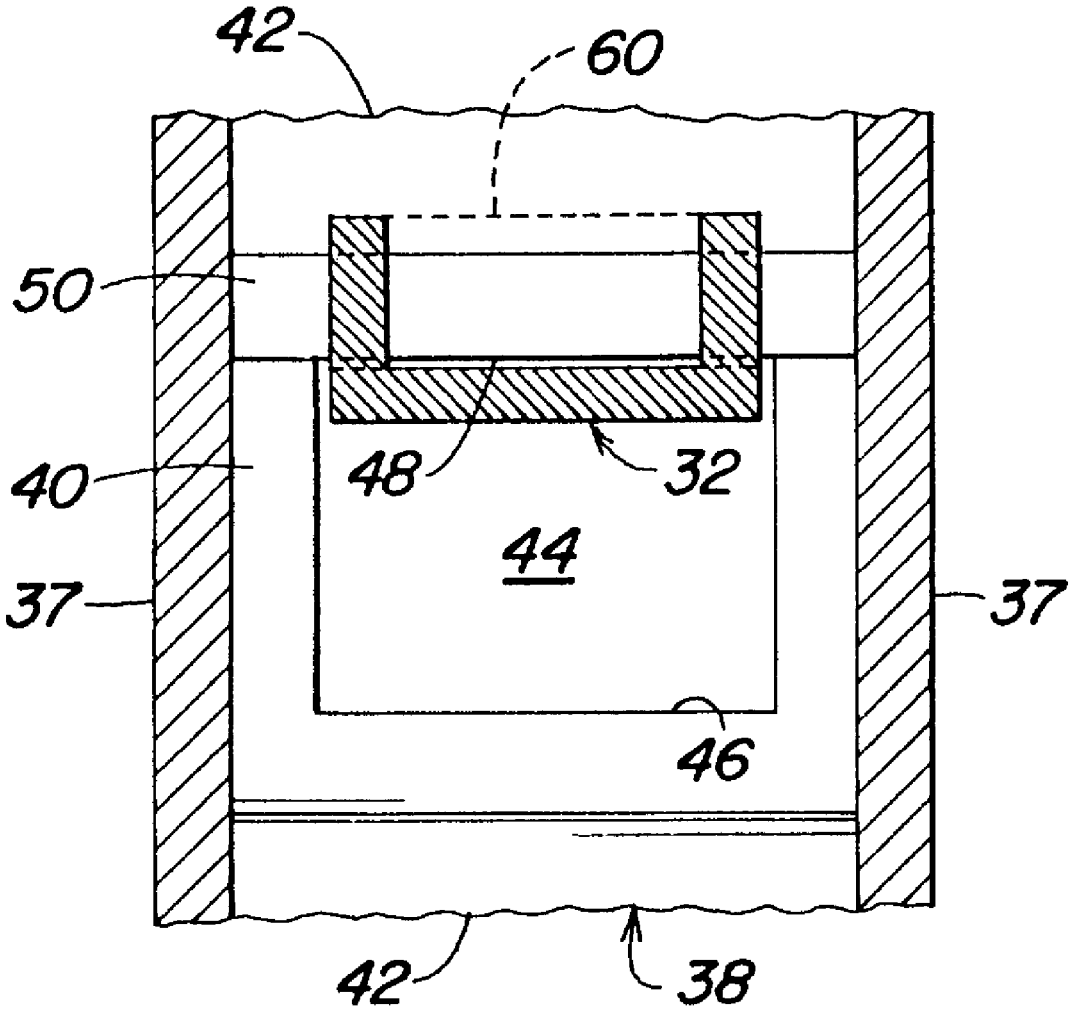
FIG. 4 is a sectional view taken along line 4—4 of FIG. 3.

Referring now to FIG. 2, there is shown the left-hand side of a parking stand assembly, this side including a support leg 28 and strut 32, connected to the left one of the arms 18, with it being understood that another support leg 28 and strut 32 is connected to the right arm 18. Specifically, each support leg 28 includes a first end region 34 attached for pivoting vertically about a connection pin 36 received in a bushing carried at an underside of the respective arm 18. As can be seen in FIG. 4, each support leg 28 consists of a parallel pair of side components 37 joined by a web or central component 38. The central component 38 is arranged between the side components 36 in such a way that at least that half of the support leg 28 which is remote from the connection pin 36 is generally H-shaped in cross section. The central component 38 is configured so as to include an inclined transition region 40 arranged between substantially parallel end regions 42. In the transition region 40, a rectangular opening 44 is provided whose edges 46 and 48 are spaced lengthwise along the stand 28. Adjacent the second edge 48, a horizontal cross pin 50 is rigidly fixed to the support leg 28.

The strut 32 is defined by a pair of opposite sides 52 interconnected by a web 53 so to form a channel which is U-shaped in cross section. The sides 52 at one end of the strut 32 project beyond the web 53 and are curved to form an arcuate stop surface 54, and is attached to the adjacent loader arm 18 for pivoting about a second pivot axis defined by a pin 55 located in a bracket fixed to the underside of the arm 18 above the connection pin 37. The opposite sides 52 of the strut 32, at their ends which are remote from the pin 55, are provided with radiused notches which define an arcuate receptacle 58. The web 53 extends beyond the receptacle 58 and is back-turned to form a hook so as to define a latch element 60 that opens toward the receptacle 58, the function of the latch element 60 being described below in greater detail.

The first and second pivot axes respectively defined by the coupling pin 37 of the support leg 28 and the coupling pin 55 of the strut 32 extend at least approximately parallel to each other and to a horizontal support plane for the loader 10. In the stored position of the parking stand shown in FIG. 2, the support leg 28 is swiveled upward so as not to interfere with the operation of the loader 10. The strut 32 then extends through the opening 44 and is positioned within a first channel defined by the opposite side components 36 of the support leg 28 and the central component 38 and lies against the component 38 throughout most of its length. On an opposite side of the component 38 from the first channel, there is formed a second channel in which is received an under side portion of the boom arm 18 to thereby secure the support leg 28 against sideways movement. As viewed in FIG. 2, the upper end of the strut 32 is secured to the adjacent loader arm 18 by a locking or retaining means 56, shown here as including a dowel pin welded to the boom arm 18 and received in a hole provided in the web 53 adjacent the latch member 60, with a releasable fastener (not shown) being associated with the pin for holding the strut 32, and hence the support leg 28, in place. The retaining means 56 could however be in a form for remote actuation such as hooks or latches that may be operated by linkages or cable controls. Alternatively, the retaining means could be of a sort actuated electrically, hydraulically or pneumatically preferably using power sources available on the tractor, but separate arrangements may also be provided. Further, a simple and cost effective retaining means could be made to include an electromagnet. For example, through the use of an electromagnet, a latch pin or lock could be controlled, with the pin being spring biased to a position so that when the electromagnet is de-energized, even by a power failure, the parking stand would remain latched in its stored position.

Figure 3:
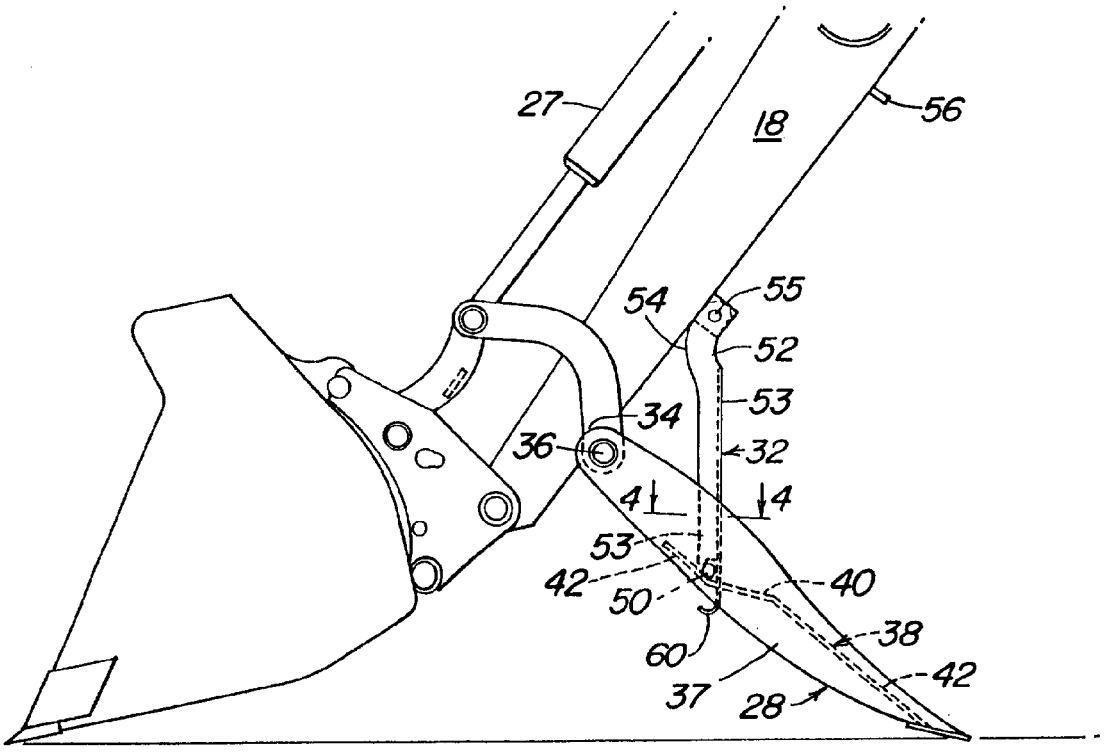
FIG. 3 is a view like FIG. 2 but showing the parking stand in a park position.

In any event, when the retaining means 56 is released, the support leg 28 tends to automatically pivot downward due to the force of gravity. If the strut 32 is manually supported in this movement, then the support leg 28 moves to correspond to the guided movement of the strut 32. In order to bring the support leg 28 again into a position in which is pivoted upward, the strut 32 is manually pivoted upward toward its stored position. Since the strut 32 extends through the opening 44, it is in contact with the opening edge 46 during both upward and downward pivoting when the strut is manually moved. At a point where the strut 32 is approximately vertical, as shown in FIG. 3, the stop surface 54 will prevent further downward movement of the strut 32 and the receptacle 58 will move to a position above the edge 48, and, hence, the pin 50, and, if the loader boom is then lowered, the pin 50 will become seated in the receptacle 58. The latch member 60 at the end of the strut 32 prevents the strut 32 from sliding out of the opening 44 as the hook-shaped end of the latch member 60 engages the pin 50 to positively stop downward movement of the support leg 28. Thereby a durable guidance is assured of the support leg 28 by the strut 32. This characteristic is advantageous, but it is not absolutely required for successful functioning of the invention.

In the park position shown in FIG. 3, the strut 32 is supported with its receptacle 58 engaged with the pin 50. This park position is reached by the loader 10 after the support leg 28 is swiveled downward, and subsequently raised slightly if necessary, by lowering the loader boom after the support leg 28 engages the ground, to thereby position the pin 50 against the strut receptacle 58. Depending on where downward movement of the strut 32 is stopped by the engagement of the stop surface 54 with the boom arm 18, the ends of the strut sides 52 may come into contact with the inner section 42 of the web 38 prior to the pin 50 becoming engaged with the receptacle 58, the strut 32 then sliding downwardly on the section 42 until the receptacle 58 engages the pin 50. An additional securing of the strut 32 in this position could be performed in the usual manner, for example, by means of the releasable fastener used at the retaining element 56, if no hook-shaped element 60 is provided on the strut 32.

What is claimed is:

1. In a loader including at least one loader arm having an implement mounted to an end thereof, a parking stand assembly associated with the arm and including a support leg and a strut, where the support leg and strut are pivotally attached to the loader arm for pivoting vertically about first and second horizontal axes, respectively, with the second pivot axis being spaced along the arm from said first pivot axis, retaining means provided on said loader arm for releasably securing said support leg and strut in a stored position extending alongside said loader arm, and said support leg and strut being respectively pivotable downwardly about said first and second pivot axes, upon release of said retaining means, to a park position wherein said strut prevents upward pivoting of said support leg from its park position and cooperates together with said implement when the latter is placed in ground engagement to support the loader on the ground, the improvement comprising: said strut and support leg respectively including first and second surfaces respectively defined by an arcuate receptacle formed adjacent an end of said strut and a cross pin fixed to said support leg which are separated from each other when said strut and support leg are in said stored position and which are disposed in confronting abutting relationship to each other only when the support leg and strut are in the park position with the support leg and strut then being so disposed relative to each other that they cooperate together to form a rigid support structure.

2. The loader defined in claim 1 wherein said support leg includes a pair of spaced sides joined by a web which extends at least one-half the length of said support leg and which cooperates with said spaced sides to define at least a first channel; and said loader arm having a portion received in said first channel when the support leg is in its stored position.

3. The loader defined in claim 2 wherein said web includes a portion which extends substantially perpendicular to said strut when the support leg and strut are in said park position; said portion of said web being provided with an opening permitting passage of said strut when the support leg is pivoted between said park and stored positions; said strut engaging an opposite side of said web from said arm when the strut and support leg are in said stored position; and said retaining means releasably securing said strut to said loader arm and thus also serving to secure said support leg to said loader arm.

4. The loader defined in claim 3 wherein said opening has an edge which defines at least a portion of a stop surface; said strut including a hook opening toward said second abutment surface and coming into engagement with said stop surface to prevent separation of said strut from said support leg when the strut and support leg are pivoting away from said park position.

5. The loader defined in claim 4 wherein said cross pin is mounted adjacent said edge and forms a portion of said stop surface.

6. The loader defined in claim 4 wherein said strut includes opposite sides joined by a web so as to be U-shaped in cross section; and said web extending beyond said sides at one end of said strut and having a back-turned terminal end defining said hook.

7. The loader defined in claim 4 wherein said strut includes opposite sides joined by a web so as to be U-shaped in cross section; and said sides each having an end provided with an arcuate recess, with the recesses together defining said second abutment surface.

8. The loader defined in claim 2 wherein said web is located such as to cooperate with the sides such that the support leg is generally H-shaped in cross section with a first channel defined at one side of said web receiving a lower portion of said loader arm and with a second channel defined at another side of said web receiving a major portion of said strut when the strut and support arm are in said stored position.

* * * * *